US008616916B2

(12) United States Patent
Teng

(10) Patent No.: US 8,616,916 B2
(45) Date of Patent: Dec. 31, 2013

(54) PANEL MODULE AND POWER INPUT CONNECTOR FIXING STRUCTURE THEREOF

(75) Inventor: Ching-Chou Teng, Taipei (TW)

(73) Assignee: Inventec Corporation, Taipei (TW)

( * ) Notice: Subject to any disclaimer, the term of this patent is extended or adjusted under 35 U.S.C. 154(b) by 68 days.

(21) Appl. No.: 13/338,913

(22) Filed: Dec. 28, 2011

(65) Prior Publication Data

US 2013/0078850 A1 Mar. 28, 2013

(30) Foreign Application Priority Data

Sep. 26, 2011 (TW) ..... 100134578 A

(51) Int. Cl.
*H01R 13/60* (2006.01)

(52) U.S. Cl.
USPC ..... 439/527; 439/939; 439/607.35

(58) Field of Classification Search
USPC ..... 439/527, 939, 456–458, 607.35
See application file for complete search history.

(56) References Cited

U.S. PATENT DOCUMENTS

| | | | | |
|---|---|---|---|---|
| 4,659,163 | A * | 4/1987 | Althouse et al. | 439/607.55 |
| 7,322,853 | B2 * | 1/2008 | Yang et al. | 439/607.28 |
| 7,357,675 | B2 * | 4/2008 | Barringer et al. | 439/607.3 |
| 7,479,036 | B2 * | 1/2009 | Briant et al. | 439/607.17 |
| 7,704,098 | B2 * | 4/2010 | Lambie et al. | 439/607.28 |
| 7,828,592 | B2 * | 11/2010 | Tobey et al. | 439/564 |

* cited by examiner

*Primary Examiner* — Hien Vu
(74) *Attorney, Agent, or Firm* — WPAT, PC; Justin King

(57) ABSTRACT

A fixing structure fixing a power input connector on a bracket is provided. The power input connector includes a socket body. The fixing structure includes a first fixing element and a second fixing element. The first fixing element has a first coupling portion and an opening, and is connected to the bracket. The second fixing element has a second coupling portion coupled to the first coupling portion. An accommodation is formed between the first fixing element and the second fixing element for accommodating the power input connector, the socket body passes through and protrudes out of the opening. The first fixing element provides a first supporting force to balance a first force pulling the power input connector away from the bracket. The second fixing element provides a second supporting force to balance a second force pressing the power input connector towards the bracket.

4 Claims, 4 Drawing Sheets

10

1

1

PANEL MODULE AND POWER INPUT CONNECTOR FIXING STRUCTURE THEREOF

This application claims the benefit of Taiwan application Ser. No. 100134578, filed Sep. 26, 2011, the subject matter of which is incorporated herein by reference.

BACKGROUND OF THE INVENTION

1. Field of the Invention

The invention relates in general to a power connector fixing structure, and more particularly to a fixing structure for fixing a power input connector on a panel.

2. Description of the Related Art

Along with the advance in technology, the all-in-one (AIO) computer including the functions of display and computer has gradually become a mainstream product in the market. The power input connector (DC-in jack) of the AIO computer has two types. The first type of power input connector provides 180 Watts (W) power, and the second type of power input connector provides 120 Watts (W) power. The power input connectors which differ in types also differ in shapes and structures.

When assembling the power input connector to a panel bracket, the power input connectors of different types are positioned in conjunction with corresponding panel brackets to match the types of the power input connectors. Since the power input connectors of different types require different panel brackets, several types of panel brackets need to be manufactured for assembling corresponding power input connectors, the assembly process is made more complicated and the manufacturing cost also increases.

SUMMARY OF THE INVENTION

The invention is directed to a fixing structure for fixing a power input connector, the power input connector resists the forces applied by the user for pressing or pulling the power input connector in different directions. Furthermore, the fixing element of the fixing structure stably assembles power input connectors of different types on the same panel bracket.

According to a first aspect of the present invention, a fixing structure for fixing a power input connector on a bracket is provided. The power input connector includes a socket body. The fixing structure includes a first fixing element and a second fixing element. The first fixing element has a first coupling portion and an opening, and is connected to the bracket. The second fixing element has a second coupling portion coupled to the first coupling portion. An accommodation is formed between the first fixing element and the second fixing element for accommodating the power input connector. The socket body passes through and protrudes out of the opening. The first fixing element provides a first supporting force to balance a first force pulling the power input connector away from the bracket. The second fixing element provides a second supporting force to balance a second force pressing the power input connector towards the bracket.

According to a second aspect of the present invention, a panel module including a power input connector, a panel, a panel bracket, and a fixing structure is provided. The power input connector includes a socket body. The panel bracket is disposed on the panel. The fixing structure for fixing a power input connector on the panel bracket includes a first fixing element and a second fixing element. The first fixing element has a first coupling portion and an opening, and is connected to the panel bracket. The second fixing element has a second coupling portion coupled to the first coupling portion. An accommodation is formed between the first fixing element and the second fixing element for accommodating the power input connector. The socket body passes through and protrudes out of the opening. The first fixing element provides a first supporting force to balance a first force pulling the power input connector away from the panel bracket. The second fixing element provides a second supporting force to balance a second force pressing the power input connector towards the panel bracket.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
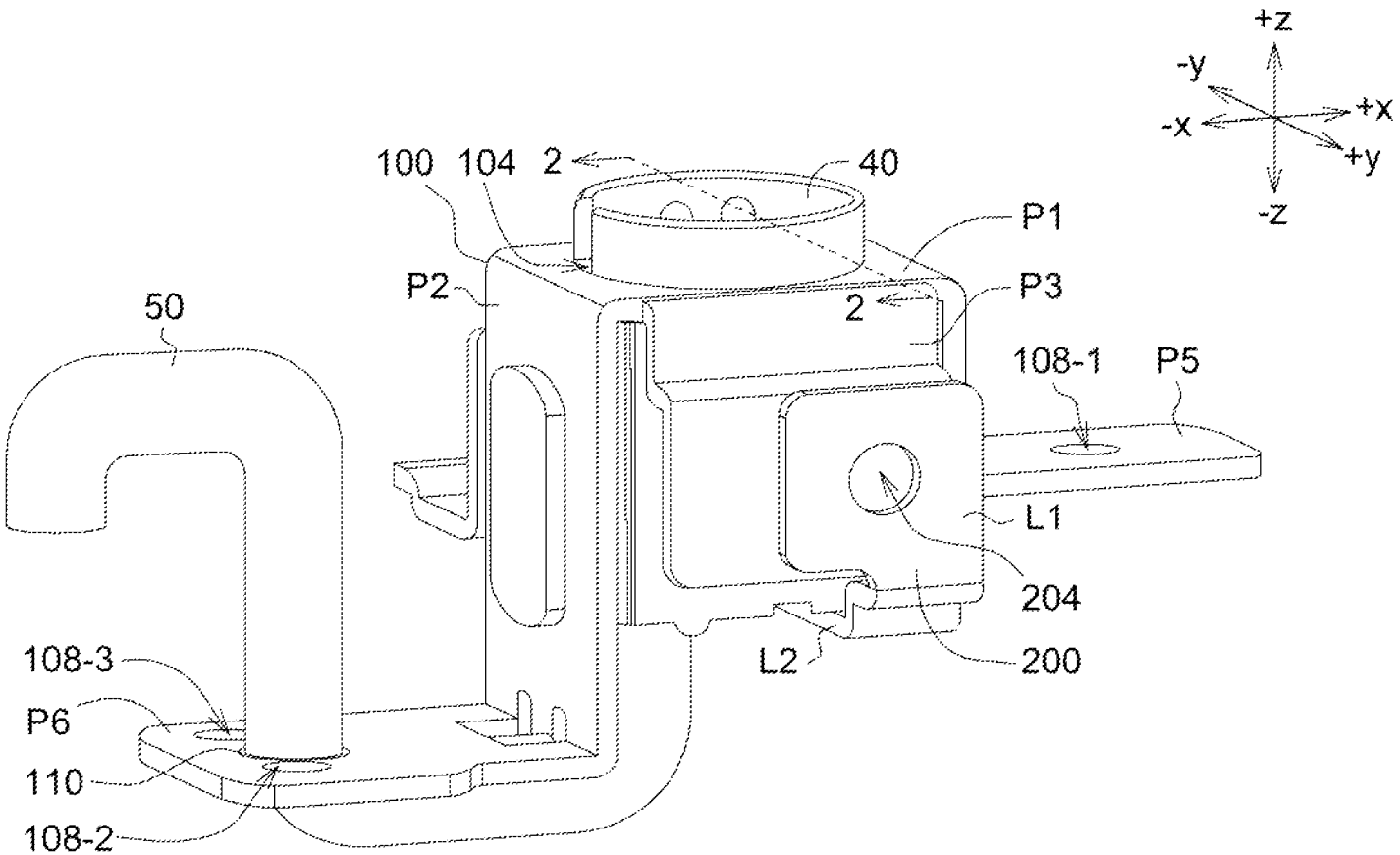
FIG. 1 shows a schematic diagram of a fixing structure according to an embodiment of the invention.

Referring to FIG. 1, a schematic diagram of a fixing structure 10 according to an embodiment of the invention is shown. The fixing structure 10 includes a first fixing element 100 and a second fixing element 200. The first fixing element 100 includes plates P1, P2, P3, P4 (illustrated in FIG. 2), P5 and P6. The plates P1, P5 and P6 are substantially parallel to each other and each has a plane normal vector with +z direction. The plate P2 is substantially perpendicular to the plate P1, and has a plane normal vector with −x direction. The plate P3 is substantially perpendicular to the plate P1, and has a plane normal vector with +y direction. The plate P4 (illustrated in FIG. 2) is substantially perpendicular to the plate P1, and has a plane normal vector with −y direction.

In the present embodiment, in the part of the first fixing element 100, the plate P1 has an opening 104, the plate P5 has a fixing hole 108-1, and the plate P6 has fixing holes 108-2 and 108-3, and a hole 110. The power input connector 40 is disposed between the first fixing element 100 and the second fixing element 200. A power trace 50 is extended from the bottom surface of the power input connector 40. In addition, the power trace 50 extends to the bottom side of the plate P6 from one side of the plate P2 of the first fixing element 100, and further passes through the hole 110 to protrude from the top side of the plate P6.

Figure 2:
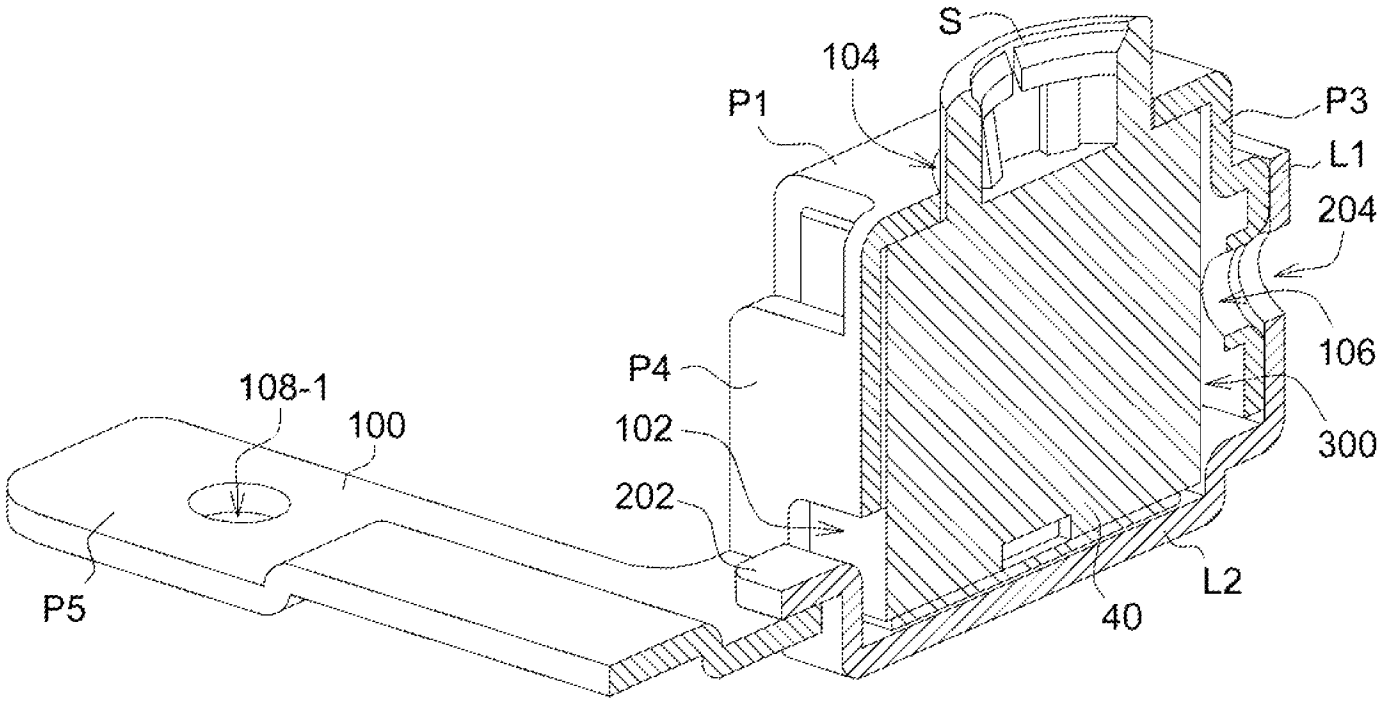
FIG. 2 shows a cross-sectional view of the fixing structure of FIG. 1 along a cross-sectional line 2-2.

Referring to FIG. 2, a cross-sectional view of the fixing structure 10 of FIG. 1 along a cross-sectional line 2-2 is shown. As indicated in FIG. 2, the plate P4 of the first fixing element 100 has a first coupling portion 102, the plate P1 of the first fixing element 100 has an opening 104, and the plate P3 of the first fixing element 100 has a hole 106. The second fixing element 200 has plates L1 and L2. The plate L1 is substantially perpendicular to the plate L2. Besides, the plate L1 has a hole 204, and a second coupling portion 202 extends from the plate L2.

In the present embodiment, an accommodation 300 is formed between the first fixing element 100 and the second fixing element 200 for accommodating the power input connector 40. The power input connector 40 has a socket body S, and after the first fixing element 100 is mounted on the power input connector 40, the socket body S further passes through and protrudes out of the opening 104. Next, the second coupling portion 202 of the second fixing element 200 is coupled to the first coupling portion 102 of the first fixing element 100 to preliminarily position the first fixing element 100 and the second fixing element 200. Meanwhile, the hole 204 of the second fixing element 200 corresponds to the hole 106 of the first fixing element 100. Then, other positioning elements (not illustrated in the diagram) such as screws passing through the hole 204 of the second fixing element and the hole 106 of the first fixing element 100 can be used to fix and fasten the first fixing element 100 and the second fixing element 200. The assembly of the power input connector 40, the first fixing element 100 and the second fixing element 200 can be completed according to the above processes.

As indicated in FIGS. 1 and 2, after the assembly is completed, the fixing structure 10 provides a first supporting force through the plate P1 of the first fixing element 100 to balance a first force pulling the power input connector 40 towards the +Z direction. Also, a second supporting force tightly pressing the bottom surface of the power input connector 40 can be provided through the plate L2 of the second fixing element 200 to balance a second force pressing the power input connector 40 towards the −Z direction. Thus, through the first fixing element 100 and the second fixing element 200, the power input connector 40 can be stably fastened, such that the power input connector 40 can resist the force applied by the user for pressing or pulling the power input connector in different directions.

Figure 3:
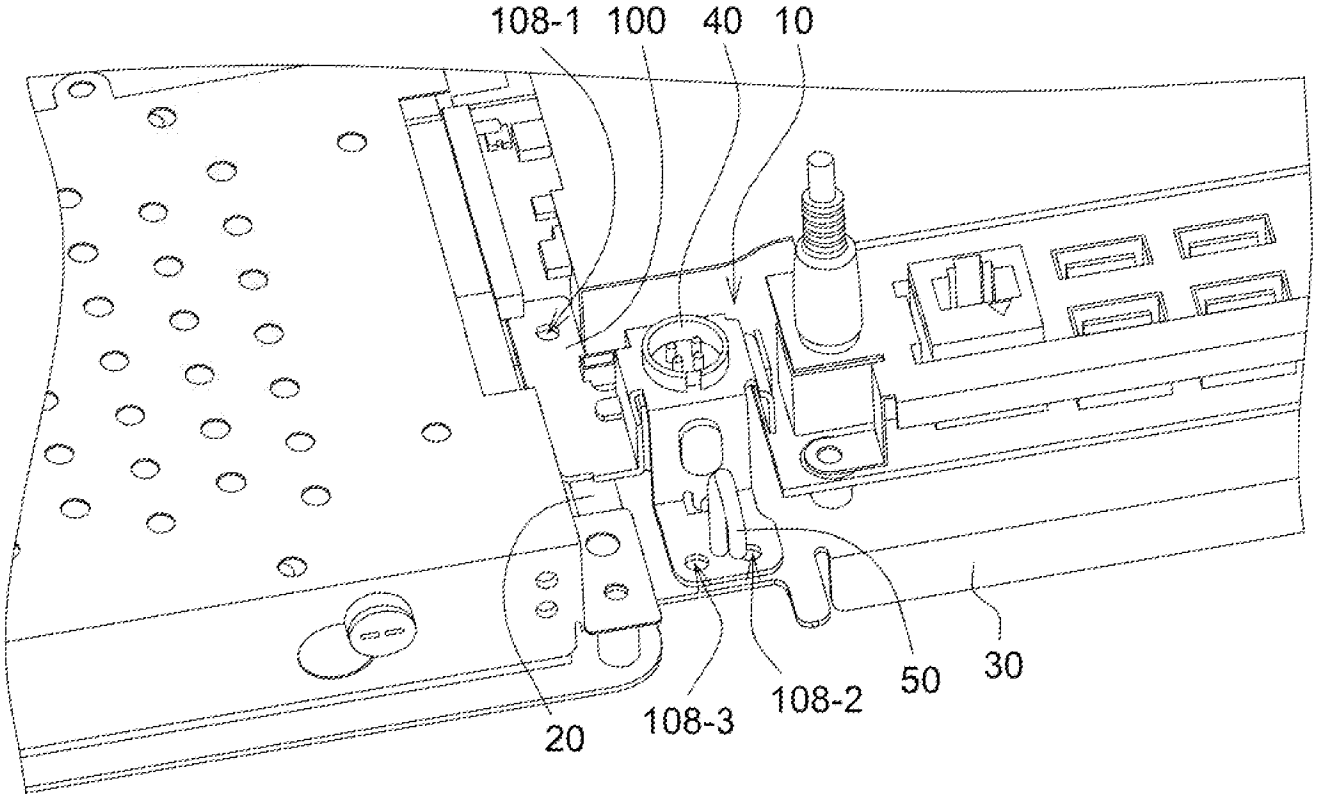
FIG. 3 shows a schematic diagram of a panel module according to an embodiment of the invention.
Figure 4:
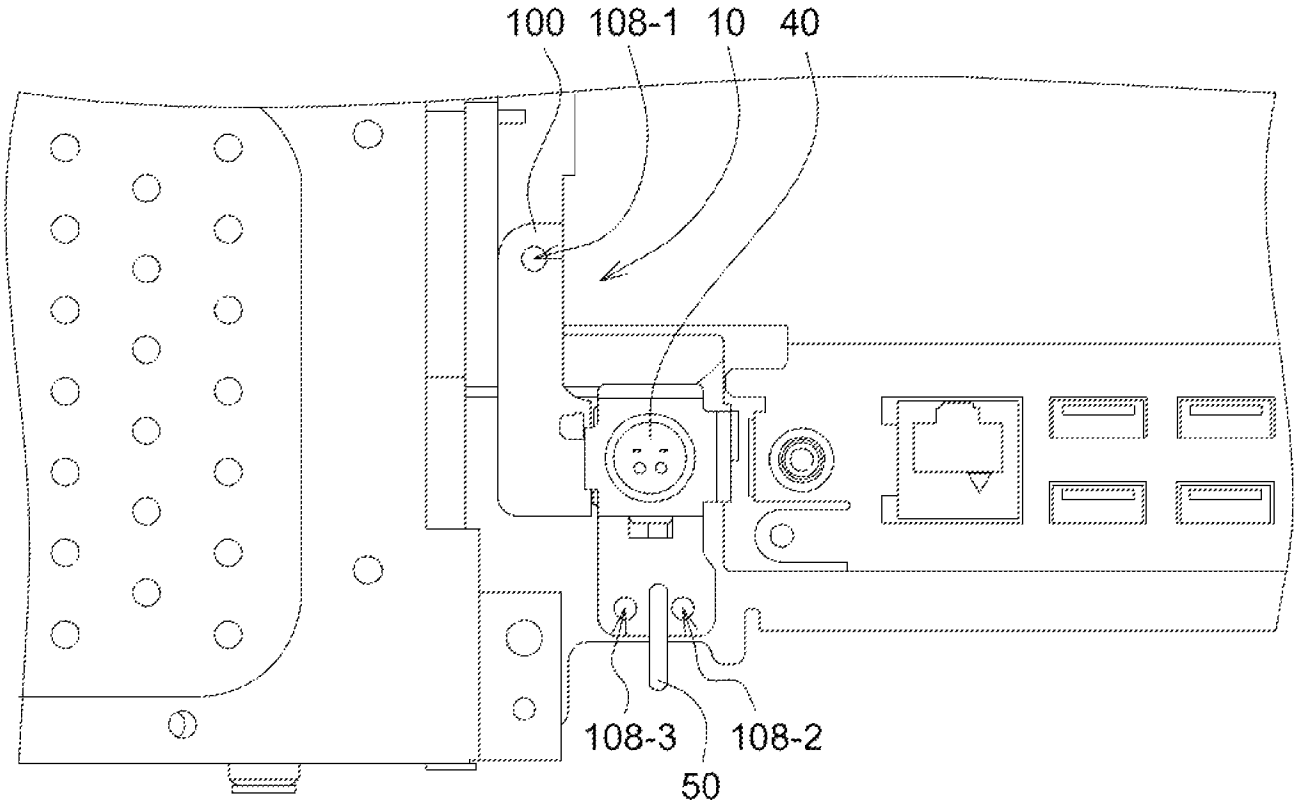
FIG. 4 shows a top view of a panel module according to an embodiment of the invention.

Refer to FIGS. 3 and 4. FIG. 3 shows a schematic diagram of a panel module 1 according to an embodiment of the invention. FIG. 4 shows a top view of a panel module 1 according to an embodiment of the invention. As indicated in FIGS. 3 and 4, the panel module 1 includes a fixing structure 10, a panel 20, a panel bracket 30 and a power input connector 40. The fixing structure 10 illustrated in FIGS. 3 and 4 is the same as the fixing structure 10 illustrated in FIGS. 1 and 2, and the details of similar structures are not repeated here. After the assembly of the first fixing element 100 and the second fixing element 200 is completed, other positioning elements (not illustrated in the diagram) such as screws passing through at least one of the fixing holes 108-1, 108-2 and 108-3 can be used to fasten the first fixing element 100 on the panel bracket 30. In the present embodiment, the first fixing element 100 preferably has three fixing holes 108-1, 108-2 and 108-3. Thus, three positioning elements can be used for fastening the fixing structure 10 on the panel bracket 30.

After the fixing structure 10 is assembled to the panel module 1, the plate P1 of the first fixing element 100 provides a first supporting force to balance a first force pulling the power input connector 40 away from the panel bracket 30 when the power input connector 40 is unplugged. Besides, a second supporting force tightly pressing the bottom surface of the power input connector 40 can be provided through the plate L2 of the second fixing element 200 to balance a second force pressing the power input connector 40 towards the panel bracket 30 when the power input connector 40 is pressed.

According to the above embodiments of the invention, the first fixing element 100 and the second fixing element 200 of the fixing structure 10 for fixing power connector can provide supporting forces to the power input connector 40 in different directions, such that the power input connector 40 can be stably fixed on the panel bracket 30. Through the use of the fixing structure 10 for fixing the power connector, the power input connector 40 resists the forces applied by the user for pressing or unplugging the power connector in different directions. Despite there are different types of power input connectors, the first fixing element 100 of the fixing structure 10 still can be used to fasten the power input connector 40 on the same panel bracket 30.

By using the fixing structure 10 of the above embodiments of the invention, the panel bracket does not need to be selected for matching the type of the power input connector, such that the type of the panel bracket can be standardized and the assembly cost of the power input connector and the panel can be reduced. As the complicated process of replacing the panel bracket to match the type of the power input connector is decrease, the manufacturing cost is further reduced.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fixing structure for fixing a power input connector on a bracket, wherein the power input connector comprises a socket body, and the fixing structure comprises:

a first fixing element having a first coupling portion and an opening, wherein the first fixing element is connected to the bracket; and a second fixing element having a second coupling portion, wherein the second coupling portion is coupled to the first coupling portion;

wherein an accommodation space is formed between the first fixing element and the second fixing element for accommodating the power input connector therewithin, the socket body passes through and protrudes out of the opening, the first fixing element provides a first supporting force against a surface of the power input connector to balance a first force pulling the power input connector away from the bracket, and the second fixing element provides a second supporting force against another surface of the power input connector to balance a second force pressing the power input connector towards the bracket;

wherein the first fixing element is mounted on the socket body of the power input connector; and wherein the second fixing element carries the power input connector to be against a bottom surface of the power input connector.

2. The fixing structure according to claim 1, wherein the first fixing element further comprises a first hole, and the second fixing element further comprises a second hole, the second hole matches the first hole, after the first fixing element is coupled with the second fixing element, the second hole substantially aligned with the first hole.

3. A panel module, comprising:

a power input connector comprising a socket body;

a panel;

a panel bracket disposed on the panel; and a fixing structure for fixing a power input connector on the panel bracket, wherein the fixing structure comprises:

a first fixing element having a first coupling portion and an opening, wherein the first fixing element is connected to the panel bracket; and a second fixing element having a second coupling portion, wherein the second coupling portion is coupled to the first coupling portion;

wherein an accommodation space is formed between the first fixing element and the second fixing element for accommodating the power input connector therewithin, the socket body passes through and protrudes out of the opening, the first fixing element provides a first supporting force against a surface of the power input connector to balance a first force pulling the power input connector away from the panel bracket, and the second fixing element provides a second supporting force against another surface of the power input connector to balance a second force pressing the power input connector towards the panel bracket;

wherein the first fixing element is mounted on the socket body of the power input connector; and wherein the second fixing element carries the power input connector to be against a bottom surface of the power input connector.

4. The panel module according to claim 3, wherein the first fixing element further comprises a first hole, and the second fixing element further comprises a second hole, the second hole matches the first hole, after the first fixing element is coupled with the second fixing element, the second hole substantially aligned with the first hole.

* * * * *